US007164776B2

(12) United States Patent
Miller et al.

(10) Patent No.: US 7,164,776 B2
(45) Date of Patent: Jan. 16, 2007

(54) VIBRATION BALANCED RECEIVER

(75) Inventors: Thomas Miller, Arlington Heights, IL (US); August Mostardo, Norridge, IL (US); Elmer Carlson, Glenview, IL (US); David E. Schafer, Glen Ellyn, IL (US)

(73) Assignee: Knowles Electronics, LLC., Itasca, IL (US)

( * ) Notice: Subject to any disclaimer, the term of this patent is extended or adjusted under 35 U.S.C. 154(b) by 1291 days.

(21) Appl. No.: 09/755,664

(22) Filed: Jan. 5, 2001

(65) Prior Publication Data

US 2001/0012375 A1 Aug. 9, 2001

Related U.S. Application Data

(63) Continuation-in-part of application No. 09/479,134, filed on Jan. 7, 2000, now abandoned.

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 7/00*** | (2006.01) |

(52) U.S. Cl. ..... 381/418; 381/417; 181/171

(58) Field of Classification Search ..... 381/396, 381/417–418, 324; 340/388.1, 388.2, 388.3, 340/388.5; 600/25

See application file for complete search history.

(56) References Cited

U.S. PATENT DOCUMENTS

| | | | | |
|---|---|---|---|---|
| 2,058,071 | A | 10/1936 | Ellmore | |
| 3,502,822 | A * | 3/1970 | Knauert et al. | 381/419 |
| 3,766,332 | A | 10/1973 | Carlson et al. | |
| 4,473,722 | A | 9/1984 | Wilton | |
| 5,647,013 | A | 7/1997 | Salvage et al. | |
| 5,757,947 | A * | 5/1998 | Van Halteren et al. | 381/417 |
| 5,809,158 | A * | 9/1998 | van Halteren et al. | 381/417 |
| 6,075,870 | A | 6/2000 | Geschiere et al. | |
| 6,563,933 | B1 | 5/2003 | Niederdraenk | |
| 2004/0167377 | A1* | 8/2004 | Schafer et al. | 600/25 |
| 2004/0168852 | A1* | 9/2004 | Jiles et al. | 181/171 |
| 2004/0258260 | A1* | 12/2004 | Thompson et al. | 381/312 |
| 2005/0002542 | A1* | 1/2005 | Warren et al. | 381/424 |

FOREIGN PATENT DOCUMENTS

| | | |
|---|---|---|
| EP | 0 548 579 A1 | 6/1993 |
| WO | WO 01/52594 A2 * | 7/2001 |

* cited by examiner

*Primary Examiner*—Curtis Kuntz
*Assistant Examiner*—Phylesha Dabney
(74) *Attorney, Agent, or Firm*—Marshall, Gerstein & Borun LLP

(57) ABSTRACT

A balanced receiver providing significantly reduced vibration is disclosed. The balanced receiver comprises a closed loop operably attached between an armature and a diaphragm. The effective moving mass of the diaphragm is designed to match the effective moving mass of the armature. The closed loop facilitates the balancing of the motion of the diaphragm and the motion of the armature, thus reducing the vibration of the receiver.

58 Claims, 3 Drawing Sheets

VIBRATION BALANCED RECEIVER

RELATED APPLICATIONS

This application is a continuation-in-part of U.S. patent application entitled, "Vibration Balanced Receiver," Ser. No. 09/479,134, filed Jan. 7, 2000 now abandoned.

TECHNICAL FIELD

The present invention relates to receivers and more particularly to a vibration balanced receiver for a hearing aid.

BACKGROUND OF THE INVENTION

Hearing aids have greatly contributed to the quality of life for those individuals with auditory problems. Technological advancements in this field continue to improve the reception, wearing comfort, life span and power efficiency of the hearing aid. In addition, several different hearing aid styles are available to choose from, i.e., behind the ear, in the ear, in the canal and completely in the canal.

The hearing aid is comprised of several components. One important component of the hearing aid is the receiver. The receiver is designed to utilize moving parts to generate acoustic energy in the ear canal of the individual using the hearing aid. Due to the motion of some of the parts within the receiver assembly, unintended vibrations may be transmitted through the receiver housing to the case of the hearing aid. In many situations, these vibrations are detrimental to the performance of the hearing aid.

The present invention is provided to solve these and other problems.

SUMMARY OF THE INVENTION

Generally stated, this invention sets forth a method and an apparatus for reducing vibration in hearing aid receiver assemblies associated with the movement of the armature-diaphragm assembly and the resulting reactionary forces. It is an object of this invention to provide a balanced receiver with significantly reduced vibration.

In accordance with the present invention, the receiver comprises a closed loop having an opposing first and a second expanded regions. An armature is operably attached to the first expanded region and a diaphragm is operably attached to the second expanded region. An effective moving mass of the armature is substantially equal to an effective moving mass of the diaphragm.

Another aspect of the present invention described above further includes the closed loop having an opposing first and a second regions. A first portion of the closed loop is adjacent the first expanded region and the first region, a second portion of the closed loop is adjacent the first region and the second expanded region, a third portion of the closed loop is adjacent the second expanded region and the second region and a fourth portion of the closed loop is adjacent the second region and the first expanded region, wherein all four portions of the closed loop are of equal length.

Yet a further aspect of the present inventions described above comprises a quadrilateral for the closed loop. The armature is operably attached near the first expanded region; and the diaphragm is operably attached near the second expanded region.

According to another aspect, the present invention comprises an elliptical-like shaped spring having a first and a second axis. A diaphragm is operably attached to the elliptical-like shaped spring near the intersection of a distal end of the second axis of the elliptical-like shaped spring. An armature is operably attached to the elliptical-like shaped spring near a proximate end of the second axis of the elliptical-like shaped spring. An effective moving mass of the armature is substantially equal to an effective moving mass of the diaphragm.

A further aspect of the invention involves a method of reducing the vibration of a receiver by providing an armature, a diaphragm and a closed loop having opposing first and second expanded regions. The armature is operably attached to the closed loop near a first expanded region and the diaphragm is operably attached to the closed loop near a second expanded region. The closed loop further having an opposing first and second regions, wherein the first and second regions are constrained from movement in a direction substantially parallel to an axis intersecting the opposing first and second expanded regions.

Yet another further aspect of the present invention involves a method of reducing the vibration of a receiver by providing an armature, a diaphragm and an elliptical-like shaped spring having a first and a second axis. The diaphragm is operably attached to the elliptical-like shaped spring near a distal end of the second axis of the elliptical-like shaped spring. The armature is operably attached to the elliptical-like shaped spring near the proximate end of the second axis of the elliptical-like shaped spring. The spring is constrained near a distal end of the first axis—a first region; and a proximate end of the first axis—a second region, wherein movement of the first and second regions in a direction parallel to the second axis is prevented.

Other advantages and aspects of the present invention will become apparent upon reading the following description of the drawings and detailed description of the invention.

DETAILED DESCRIPTION OF THE PREFERRED EMBODIMENT

Figure 1:
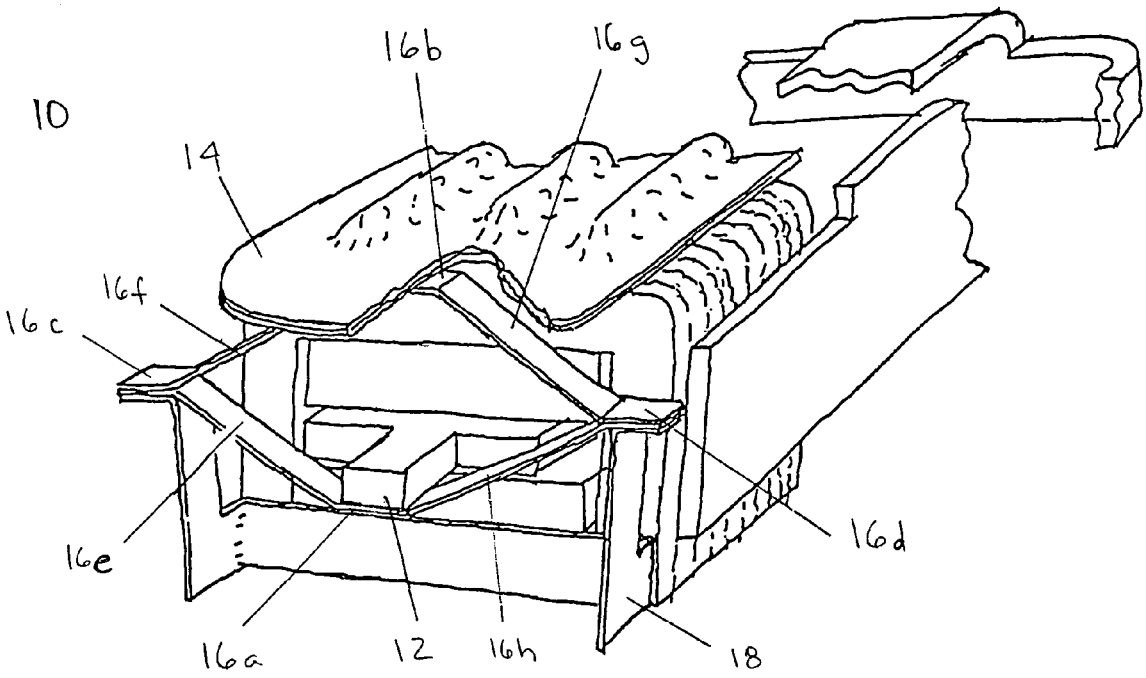
FIG. 1 is a perspective view of the receiver.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
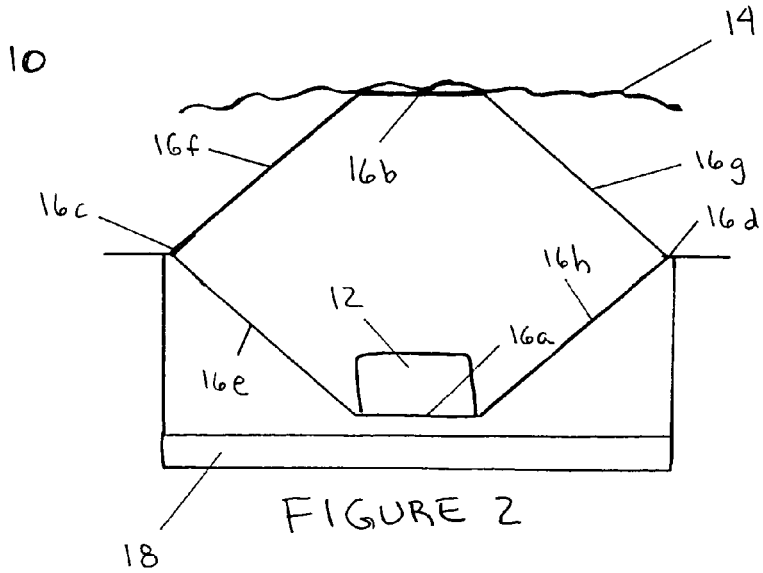
FIG. 2 is a front view of the receiver of FIG. 1.

To improve the performance of a hearing aid, a receiver 10 can be designed to minimize or eliminate vibration within the receiver assembly. The receiver assembly 10 is illustrated in the FIGS. 1 and 2. The receiver 10 includes an armature 12 and a diaphragm 14. The armature 12 and the diaphragm 14 are both operably attached to a closed loop 16, preferably a pantograph. The closed loop 16, i.e., quadrilateral, serves as a connection between the diaphragm 14 and the armature 12. The quadrilateral structure 16 consists of an opposing first and second expanded regions 16*a*, 16*b* and an opposing first and second regions 16*c*, 16*d*. In addition to the regions 16*a*, (expanded) 16*b*, (expanded) 16*c*, 16*d*, there are four portions, or sides 16*e*, 16*f*, 16*g*, 16*h*. The first portion 16*e* is adjacent the first expanded region 16*a* and the first 16*c* region. The second portion 16*f* is adjacent the first region 16*c* and second expanded 16*b* region. The third portion 16*g* is adjacent the second expanded region 16*b* and the second region 16*d*. The fourth portion 16*h* is adjacent the second region 16*d* and the first expanded 16*a* region. The armature 12 is operably attached to the quadrilateral structure 16 near the first expanded region 16*a*. The diaphragm 14 is operably attached to the quadrilateral structure 16 near the opposing expanded region 16*b*.

Alternatively, the structure of the closed loop 16 can be an elliptical-like shape and having an ellipticity of varying deviations. The elliptical-like shape comprising the structure of an elongated circle, oval, ellipse, hexagon, octagon or sphere.

The diaphragm 14 is preferably designed to have the same effective moving mass as the effective moving mass of the armature 12. Opposing regions 16*c* and 16*d* of the quadrilateral structure 16 are constrained by a bracket 18, thus preventing movement of the opposing regions 16*c* and 16*d* in a direction parallel to an axis (not shown) intersecting the opposing expanded regions 16*a*, 16*b*. Movement by the armature 12 is accompanied by an opposing movement of the diaphragm 14, thus the opposing motions of the armature 12 and diaphragm 14 work to effectively negate a relocation of the center of gravity within the receiver 10. A movement inward, toward the center of the closed loop 16, of the armature 12 causes an outward movement, away from the center of the closed loop, of the restrained regions 16*c*, 16*d* and thus, cause an inward movement of the diaphragm 14. Preferably, the four portions 16*e*, 16*f*, 16*g*, 16*h* are straight segments that allow for better transfer of motion through the quadrilateral structure 16.

Figure 6:
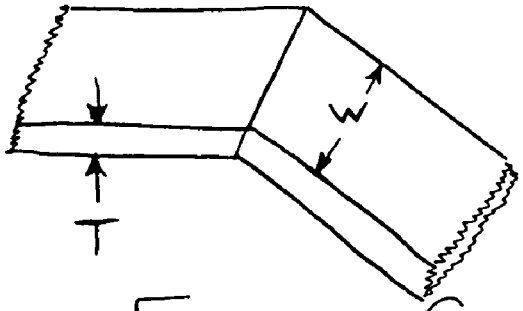

FIG. 6 depicts a partial view of the closed loop 16 as a strap having a thickness, T, ranging from $5\times10^{-4}$ to $3\times10^{-3}$ inch and a width, W, ranging from $10\times10^{-3}$ to $20\times10^{-3}$ inch. Preferably, the strap has a thickness of $5\times10^{-4}$ inch and a width between $10\times10^{-3}$ to $20\times10^{-3}$ inch. Alternatively, the closed loop 16 can be comprised of a wire, e.g., stainless steel, etc., having a diameter ranging from $2.0\times10^{-3}$ to $5.0\times10^{-3}$ inch. The strap experiences less maximum stress during operation of the pantograph 16 as compared to the wire. Thus, the receiver 10 can be operated at a higher output before material fatigue becomes a concern.

Figure 3:
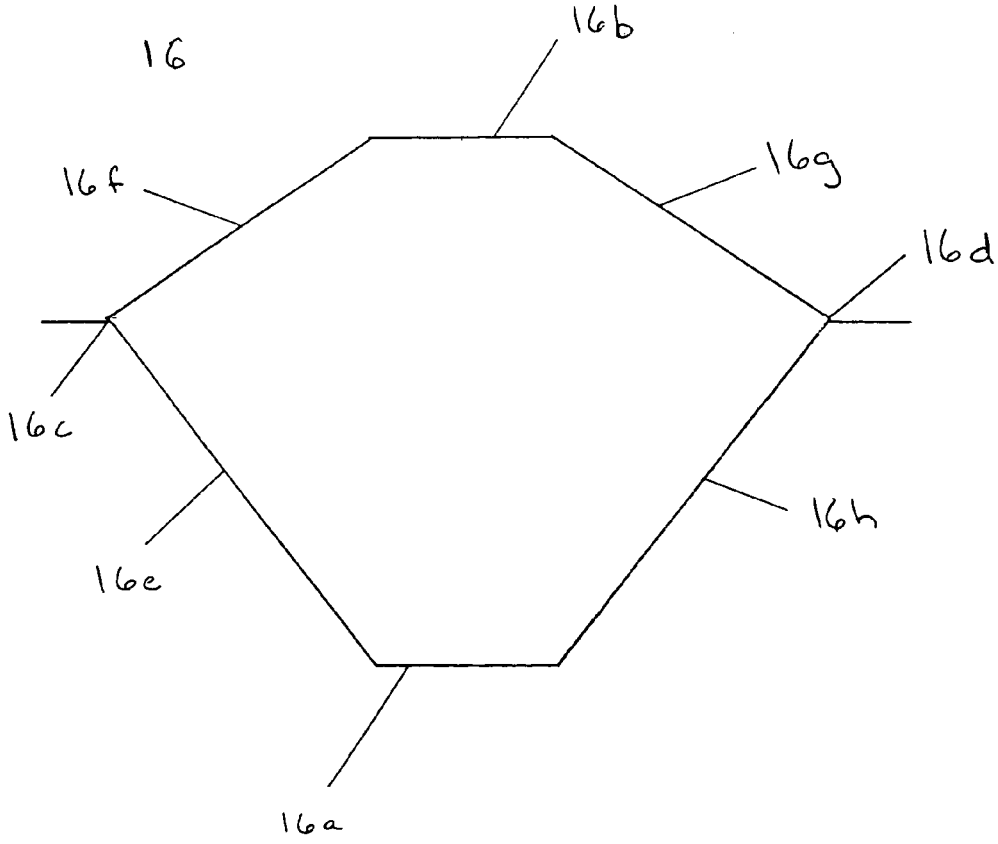
FIG. 3 is an alternative embodiment of the closed loop of FIG. 1.

Increasing or decreasing the motion transfer by the quadrilateral structure assembly 16 can be accomplished by varying the length of the first 16*e* and fourth 16*h* portions in relation to the length of the second 16*f* and third 16*g* portions. See FIG. 3. For instance, increasing the length of the first 16*e* and fourth portion 16*h* to be equal to each other and greater then the length of the second 16*f* and third 16*g* portion, will, for the motion of region 16*a*, increase the motion of the quadrilateral structure 16 assembly at region 16*b*.

Figure 4:
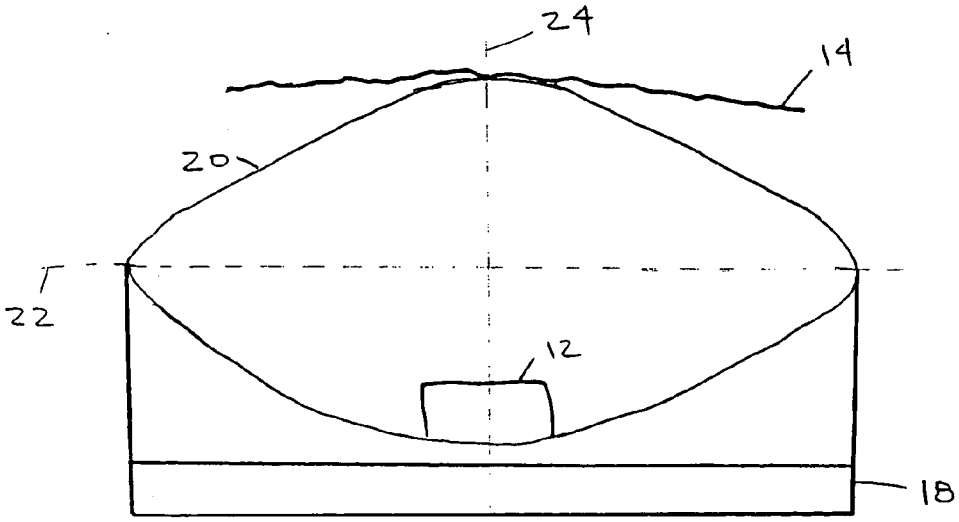
FIG. 4 is a front view of an alternative embodiment of the present invention.

An alternative embodiment incorporates a spring 20 in place of the quadrilateral structure 16 as shown in FIG. 4. The spring 20 has a first axis 22 and a second axis 24 (shown in phantom). The diaphragm 14 is operably attached to the spring 20 near a distal end of the second axis 24 and an armature 12 is operably attached to the spring 20 near a proximate end of the second axis 24.

Figure 5:
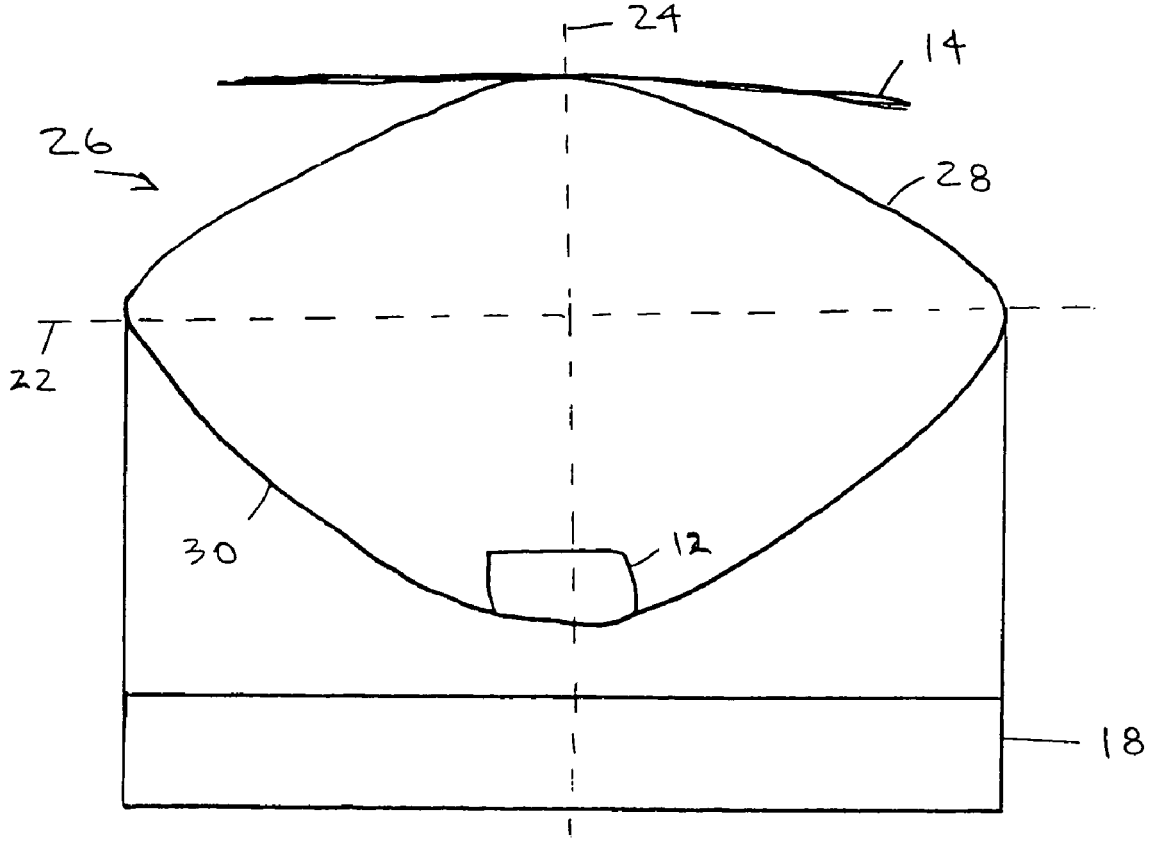
FIG. 5 is a front view of an alternative embodiment of the present invention; and, FIG. 6 is a partial perspective view of a closed loop comprised of a strap.

It is further contemplated by this invention that an elliptical-like shaped spring 26 be used. The spring 26 can be an ellipse or a variation thereof. See FIG. 5. A first axis 22 divides the spring 26 into two members 28, 30. The length of one member 28 is longer or shorter than the length of the other member 30. This embodiment is similar to the previously mentioned embodiment of the quadrilateral structure 16 having first 16*e* and fourth 16*h* portions of substantially equal and longer (or shorter) length than the length of the second 16*f* and third 16*g* portions. Analogous to the embodiment of the quadrilateral structure 16, the motion of the elliptical-like shaped spring 26 may be increased (or decreased) by differing the lengths of the members 28, 30.

While specific embodiments have been illustrated and described, numerous modifications come to mind without significantly departing from the spirit of the invention and the scope of protection is only limited by the scope of the accompanying claims.

We claim:

1. A receiver, comprising:

an armature;

a diaphragm; and, a closed loop having an opposing first expanded and a second expanded regions, the first expanded region being joined to the second expanded region such that motion of the first expanded region in a first direction causes motion of the second expanded region in a second direction, different than the first direction, wherein the armature is operably attached to the first expanded region and the diaphragm is operably attached to the second expanded region.

2. The receiver of claim 1 further comprising the closed loop having an opposing first and a second regions, wherein the first and second regions are constrained to prevent motion of the first and second regions in a direction parallel to an axis intersecting the first and second expanded regions.

3. The receiver of claim 1, further comprising:

the armature having an effective moving mass; and, the diaphragm having an effective moving mass, wherein the effective moving mass of the armature is substantially equal to the effective moving mass of the diaphragm.

4. The receiver of claim 1 wherein the closed loop is comprised of a strap.

5. The receiver of claim 4 wherein the strap is comprised of stainless steel.

6. The receiver of claim 4 wherein the strap has a thickness ranging from $5\times10^{-4}$ to $3\times10^{-3}$ inch and a width ranging from $10\times10^{-3}$ to $20\times10^{-3}$ inch.

7. The receiver of claim 1 wherein the closed loop is comprised of a wire.

8. The receiver of claim 7 wherein the wire is comprised of stainless steel.

9. The receiver of claim 7 wherein the wire has a diameter having a range of $2.0\times10^{-3}$ to $5.0\times10^{-3}$ inch.

10. The receiver of claim 1 wherein the closed loop is a quadrilateral.

11. The receiver of claim 10 wherein the quadrilateral is a rhombus.

12. The receiver of claim wherein the closed loop further comprises:

an opposing first and a second regions; and a first, a second, a third and a fourth portions, wherein the first portion is adjacent the first expanded region and the first region, the second portion is adjacent the first region and the second expanded region, the third portion is adjacent the second expanded region and the second region and the fourth portion is adjacent the second region and the first expanded region.

13. The receiver of claim 12 wherein the first and fourth portions have a substantially equal length and the second and third portions have substantially equal length.

14. The receiver of claim 13 wherein the first and second portions have an unequal length.

15. The receiver of claim 12 wherein the opposing first and second regions are constrained to prevent motion of the first and second regions in a direction parallel to an axis intersecting the first and second expanded regions.

16. The receiver of claim 13 wherein the opposing first and second regions are constrained to prevent motion of the first and second regions in a direction parallel to the line connecting the first and second expanded regions.

17. The receiver of claim 14 wherein the opposing first and second regions are constrained to prevent motion of the first and second regions in a direction parallel to the line connecting the first and second expanded regions.

18. A receiver, comprising:

an armature;

a diaphragm;

an elliptical-like shaped spring having a first axis and a second axis, each of the axes having a distal and a proximate end;

the diaphragm operably attached to the elliptical-like shaped spring near the distal end of the second axis of the elliptical spring; and the armature operably attached to the elliptical-like shaped spring near the proximate end of the second axis of the elliptical spring, wherein the distal end is joined to the proximate end such that motion of the distal in a first direction causes motion of the proximate end in a second direction, different than the first direction.

19. The receiver of claim 18 wherein the elliptical-like shaped spring is constrained near the proximate end of the first axis—a first region; and the distal end of the first axis—a second region; to prevent motion of the first and second regions in a direction parallel to the second axis.

20. The receiver of claim 18 further comprising:

the armature having an effective moving mass; and, the diaphragm having an effective moving mass, wherein the effective moving mass of the armature is substantially equal to the effective moving mass of the diaphragm.

21. The receiver of claim 18 wherein the elliptical-like shaped spring is comprised of a strap.

22. The receiver of claim 21 wherein the strap is comprised of stainless steel.

23. The receiver of claim 21 wherein the strap has a thickness ranging from $5\times10^{-4}$ to $3\times10^{-3}$ inch and a width ranging from $10\times10^{-3}$ to $20\times10^{-3}$ inch.

24. The receiver of claim 18 wherein the elliptical-like shaped spring is comprised of a wire.

25. The receiver of claim 24 wherein the wire is comprised of stainless steel.

26. The receiver of claim 24 wherein the wire has a diameter having a range of $2.0\times10^{-3}$ to $5.0\times10^{-3}$ inch.

27. The receiver of claim 18, wherein the elliptical-like shaped spring is comprised of stainless steel.

28. A method of reducing vibration in a receiver, comprising the steps of:

providing an armature;

providing a diaphragm;

providing a closed loop, the closed loop having an opposing first and a second expanded regions and an opposing first and a second regions;

operably attaching the armature to the first expanded region;

operably attaching the diaphragm to the second expanded region; and, joining the first expanded region and the second expanded region such that motion of the first expanded region in a first direction causes motion of the second expanded region in a second direction, different than the first direction.

29. The method of claim 28 further comprising constraining the first and second regions to prevent motion of the first and second regions in a direction substantially parallel to an axis intersecting the first and second expanded regions.

30. The method of claim 28 further comprising:

the armature having an effective moving mass; and, the diaphragm having an effective moving mass, wherein the effective moving mass of the armature is substantially equal to the effective moving mass of the diaphragm.

31. The method of claim 28 wherein the closed loop is comprised of stainless steel strap.

32. The method of claim 31 wherein the stainless steel strap has a thickness ranging from $5\times10^{-4}$ to $3\times10^{-3}$ inch and a width ranging from $10\times10^{-3}$ to $20\times10^{-3}$ inch.

33. The method of claim 28 wherein the closed loop is a quadrilateral.

34. The method of claim 33 wherein the quadrilateral is a rhombus.

35. The method of claim 28 wherein the closed loop further comprises:

a first, a second, a third and a fourth portions, wherein the first portion is adjacent the first expanded region and the first region, the second portion is adjacent the first region and the second expanded region, the third portion is adjacent the second expanded region and the second region, and the fourth portion is adjacent the second region and the first expanded region.

36. The method of claim 35 wherein the first and fourth portions have substantially equal length and the second and third portions have substantially equal length.

37. The method of claim 36 wherein the first and second portions have unequal length.

38. The method of claim 35 wherein the opposing first and second regions are constrained to prevent motion of the first and second regions in a direction parallel to an axis intersecting the first and second expanded regions.

39. The method of claim 36 wherein the opposing first and second regions are constrained to prevent motion of the first and second regions in a direction parallel to an axis intersecting the first and second expanded regions.

40. The method of claim 37 wherein the opposing first and second regions are constrained to prevent motion of the first and second regions in a direction parallel to an axis intersecting the first and second expanded regions.

41. A method of reducing vibration in a receiver, comprising the steps of:

providing an armature;

providing a diaphragm;

providing an elliptical-like shaped spring, the elliptical-like shaped spring having a first axis and a second axis, each of the axes having a distal and a proximate end;

operably attaching the armature to the elliptical-like shaped spring near the proximate end of the second axis;

operably attaching the diaphragm to the elliptical-like shaped spring near the distal end of the second axis; and, joining the distal end and the proximate end such that motion of the distal in a first direction causes motion of the proximate end in a second direction, different than the first direction.

42. The method of claim 41 further comprising:

constraining the elliptical-like shaped spring near the proximate end of the first axis—a first region; and, constraining the elliptical-like shaped spring near the distal end of the first axis—a second region, wherein motion of the first and second regions in a direction parallel to the second axis is prevented.

43. The method of claim 41 further comprising:

the armature having an effective moving mass; and, the diaphragm having an effective moving mass, wherein the effective moving mass of the armature is substantially equal to the effective moving mass of the diaphragm.

44. The method of claim 41, wherein the elliptical-like shaped spring is comprised of a strap.

45. The method of claim 41 wherein the strap is comprised of stainless steel.

46. The method of claim 44 wherein the strap has a thickness ranging from $5\times10^{-4}$ to $3\times10^{-3}$ inch and a width ranging from $10\times10^{-3}$ to $20\times10^{-3}$ inch.

47. A receiver, comprising:

an armature;

a diaphragm;

a closed loop having an opposing first expanded and a second expanded regions, wherein the armature is operably attached to the first expanded region and the diaphragm is operably attached to the second expanded region; and wherein the closed loop further comprises:

opposing first and a second regions; and a first, a second, a third and a fourth portions, wherein the first portion is adjacent the first expanded region and the first region, the second portion is adjacent the first region and the second expanded region, the third portion is adjacent the second expanded region and the second region and the fourth portion is adjacent the second region and the first expanded region.

48. The receiver of claim 47 wherein the first and fourth portions have a substantially equal length and the second and third portions have substantially equal length.

49. The receiver of claim 48 wherein the first and second portions have an unequal length.

50. The receiver of claim 47 wherein the opposing first and second regions are constrained to prevent motion of the first and second regions in a direction parallel to an axis intersecting the first and second expanded regions.

51. The receiver of claim 48 wherein the opposing first and second regions are constrained to prevent motion of the first and second regions in a direction parallel to the line connecting the first and second expanded regions.

52. The receiver of claim 49 wherein the opposing first and second regions are constrained to prevent motion of the first and second regions in a direction parallel to the line connecting the first and second expanded regions.

53. A method of reducing vibration in a receiver, comprising the steps of:

providing an armature;

providing a diaphragm;

providing a closed loop, the closed loop having an opposing first and a second expanded regions and an opposing first and a second regions;

operably attaching the armature to the first expanded region;

operably attaching the diaphragm to the second expanded region;

wherein the closed loop further comprises:

first, second, third and fourth portions, wherein the first portion is adjacent the first expanded region and the first region, the second portion is adjacent the first region and the second expanded region, the third portion is adjacent the second expanded region and the second region, and the fourth portion is adjacent the second region and the first expanded region.

54. The method of claim 53 wherein the first and fourth portions have substantially equal length and the second and third portions have substantially equal length.

55. The method of claim 54 wherein the first and second portions have unequal length.

56. The method of claim 53 wherein the opposing first and second regions are constrained to prevent motion of the first and second regions in a direction parallel to an axis intersecting the first and second expanded regions.

57. The method of claim 54 wherein the opposing first and second regions are constrained to prevent motion of the first and second regions in a direction parallel to an axis intersecting the first and second expanded regions.

58. The method of claim 55 wherein the opposing first and second regions are constrained to prevent motion of the first and second regions in a direction parallel to an axis intersecting the first and second expanded regions.

* * * * *